US005562804A

United States Patent [19]

Tuominiemi et al.

[11] Patent Number: 5,562,804

[45] Date of Patent: Oct. 8, 1996

[54] METHOD FOR ADJUSTING THE SULPHUR/SODIUM RATIO IN THE FLUE GASES OF A SODA RECOVERY BOILER

[75] Inventors: Seppo Tuominiemi, Pirkkala; Esa Pikkujämsä, Tampere; Keijo Imeläinen, Keminmaa; Pauli Harila, Kemi; Veli-Antti Kivilinna, Lautiosaari; Ahti Klami, Kemi, all of Finland

[73] Assignee: Tampella Power Oy, Tampere, Finland

[21] Appl. No.: 278,410

[22] Filed: Jul. 21, 1994

[30] Foreign Application Priority Data

Jul. 23, 1993 [FI] Finland ..... 933335

[51] Int. Cl.[6] ..... D21C 11/06

[52] U.S. Cl. ..... 162/15; 162/31; 162/16; 162/51; 423/DIG. 3

[58] Field of Search ..... 162/29, 30.1, 31, 162/14, 15, 16, 51; 423/234, 232, DIG. 3

[56] References Cited

FOREIGN PATENT DOCUMENTS 2078959 3/1993 Canada .

56714 11/1979 Finland .

OTHER PUBLICATIONS

Terry, Adams, "Kraft Recovery Boiler Physical & Chemical Processes", 1988, American Paper Institute, pp. 34–37, 188–203.

Finnish patent application No. 914521 (9 pgs.).

*Primary Examiner*—Donald E. Czaja
*Assistant Examiner*—Dean T. Nguyen
*Attorney, Agent, or Firm*—Dressler, Goldsmith, Milnamow & Katz, Ltd.

[57] ABSTRACT

A method for adjusting the sulphur/sodium ratio in a soda recovery boiler when strong sulphurous odour gases are burned therein. According to the method, sodium is introduced into the soda recovery boiler in an amount proportional to the amount of sulphur either as sodium hydroxide, sodium carbonate compounds or soap, whereby the sodium and sulphur react, forming sodium sulphate, which can be removed from the flue gases together with fly ash.

5 Claims, 1 Drawing Sheet

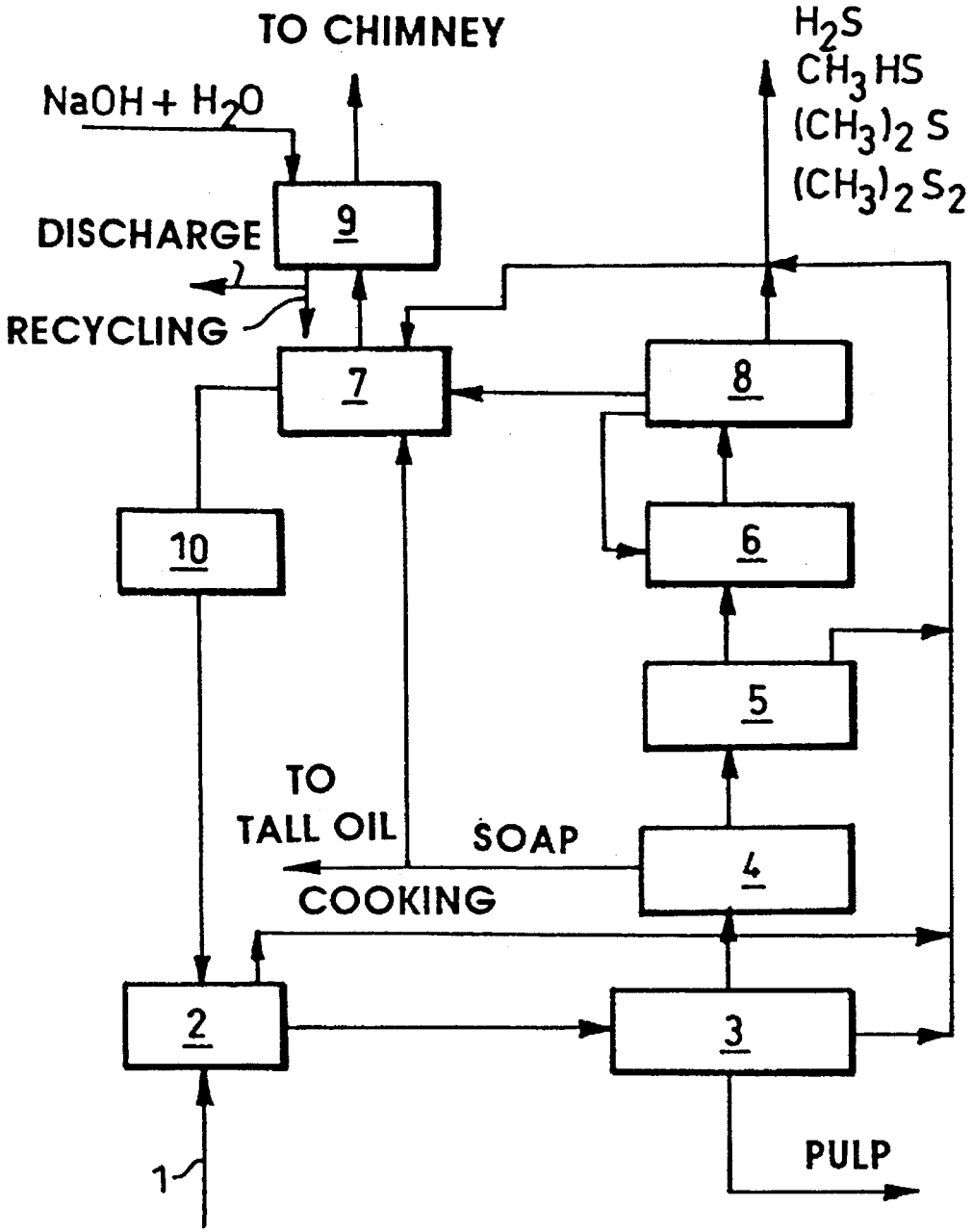
TO CHIMNEY
$H_2S$
$CH_3HS$
$(CH_3)_2S$
$(CH_3)_2S_2$
$NaOH + H_2O$
DISCHARGE
RECYCLING
9
7
8
10
6
5
TO
TALL OIL
SOAP
COOKING
4
2
3
1
PULP

METHOD FOR ADJUSTING THE SULPHUR/SODIUM RATIO IN THE FLUE GASES OF A SODA RECOVERY BOILER

BACKGROUND OF THE INVENTION

The invention relates to a method for adjusting the sulphur/sodium ratio in the flue gases of a soda recovery boiler when sulphurous odour gases are burned in the boiler.

Strong odour gases are produced in different steps of a sulphate pulp process, for instance in the digester house and the evaporation plant and during the stripping of condensates. In addition, strong odour gases are released from the expansion tank of the final concentrator. These gases contain various sulphurous compounds, e.g. $H_2S$, $CH_3HS$, $(CH_3)_2S$, $(CH_3)_2S_2$. Diluted odour gases are released in the washer room and the tall oil cooking unit and together with vapours from dissolver tanks or the like. They contain small amounts of odorous sulphur such as $H_2S$ or other odorous, mainly organic sulphur compounds. In this application and the appended claims the terms strong and diluted odour gases refer to the odour gases described above, whereas the term flue gases refers to gases which are contained in the soda recovery boiler and conducted to a flue gas duct and further onwards.

Odour gases are typically burned e.g. in a lime sludge reburning kiln or a separate odour gas boiler to recover their heat content and to separate sulphur from the flue gases so that it can be recycled to the chemical cycle. If odour gases with a high sulphur content are supplied to a soda recovery boiler, the amount of sulphur—typically sulphur dioxide and to some extent sulphur trioxide—increases in the flue gases. The excessive presence of these compounds renders the fly ash acidic, which results in the clogging of the heat surfaces of the boiler and, without a separate flue gas scrubber, even in an increase in sulphur emissions.

The building of a separate odour gas boiler or odour gas burning apparatus and its use in the removal of odour gases requires major investments and, in addition to odour gases, fuel must continuously be fed into it in order to keep the burning under control. Moreover, the resulting flue gases must be scrubbed, which in turn causes extra operating costs.

DESCRIPTION OF THE INVENTION

The object of the present invention is to provide a method which enables the burning of odour gases in a soda recovery boiler without increasing sulphur emissions. In addition, the boiler remains long in good condition.

The method according to the invention is characterized in that sodium is separately introduced into the soda recovery boiler as a suitable compound and in such an amount that the sulphur dioxide in the soda recovery boiler together with the sodium forms sodium sulphate, which can be separated from the flue gases of the soda recovery boiler in solid form.

The essential idea of the invention is to introduce strong odour gases, and preferably all odour gases, into a soda recovery boiler for burning and also to introduce sodium into it as a NaOH solution, another Na chemical or soap so as to keep the S/Na ratio in the flue gases of the boiler advantageous. An advantage of the method according to the invention is that it is not necessary to have a separate burning apparatus or the like for strong odour gases or other odour gases, but they can be burned in a soda recovery boiler. A further advantage of the method according to the invention is that the burning of sulphurous odour gases does not increase sulphur emissions, as the advantageous S/Na ratio in the flue gases of a soda recovery boiler can easily be maintained by using either sodium hydroxide, sodium carbonate compounds such as sodium bicarbonate, other suitable Na compounds, or excess soap, depending on the situation. If soap is used, the thermal energy contained in the soap is recovered. At the same time the thermal energy of the odour gases is also recovered in the soda recovery boiler. Still another advantage of the invention is that the burning conditions in the soda recovery boiler are advantageous, and detrimental compounds such as CO are hardly produced. Furthermore, the process and apparatus for scrubbing the flue gases of a soda recovery boiler are so efficient that all remaining impurities are removed.

In the following the invention will be described in greater detail with reference to the accompanying drawing, which schematically illustrates a pulp cooking process for which the method can be applied.

BRIEF DESCRIPTION OF THE DRAWING

FIG. 1 is a schematic view of an exemplary system for adjusting the sulfur to sodium ratio in the flue gases of a soda recovery boiler according to the invention.

DETAILED DESCRIPTION OF THE INVENTION

The figure illustrates a pulp cooking process which is conventional as such. The wood material 1 to be cooked is introduced into a digester 2. In the digester it is cooked with cooking liquor to form pulp, whereafter the used cooking liquor, or black liquor, is washed from the pulp in a washing step 3, and the washed pulp is supplied forward for further treatment. The black liquor is further supplied to a soap separation step 4 and therefrom to evaporation steps 5 and 6, in which water is separated from it until it is finally concentrated to a dry matter content as high as possible. The soap in turn is usually supplied to a tall oil cooking step, but according to the invention, part of the soap, or in some cases all of it, can be supplied to a soda recovery boiler 7. At present it is known that in the initial step 5 the black liquor is concentrated by low-pressure steam. Subsequently it is further concentrated 6 at a pressure higher than atmospheric pressure by means of high-pressure steam either directly or indirectly by heating. The resulting liquor has a dry matter content of even 75 to 90% and is under such a pressure and its temperature is such that it can be further supplied by means of a pump to the soda recovery boiler 7. After the normal evaporation plant 5 the figure shows such a concentration unit 6, from which the liquor is supplied to a separate expansion tank 8, where steam and also various strong sulphurous odour gases such as $H_2S$, $CH_3HS$, $(CH_3)_2S$, $(CH_3)_2S_2$, etc., are released therefrom while the pressure still slightly falls. Sulphurous odour gases ape produced during the cooking 2 of pulp, in the evaporation plant 5, in the expansion tank 8 following the concentration, and also during the washing 3 of the liquor. These processes and apparatuses pertaining to the cooking of pulp are generally fully known and self-evident to one skilled in the art, wherefore they will not be dealt with more closely herein.

In the initial step of pre-evaporation, soap is at first separated from the black liquor to be burned, whereafter the black liquor is further evaporated to obtain a higher dry matter content. The separation of soap is necessary in order to prevent the heat surfaces at the end of the evaporation plant from becoming dirty and clogged.

Strong odour gases and possibly even other odour gases released during different steps of the process are supplied to the soda recovery boiler either through their own burner or through a burner connected to the soda recovery boiler in order for their thermal energy to be recovered. To prevent an increase in sulphur emissions and to enable advantageous separation of sulphur from the flue gases of a soda recovery boiler, it is necessary to keep the S/Na ratio of the flue gases of the boiler such that the sulphur and sodium react in the boiler to form sodium sulphate; being a solid, sodium sulphate is separated from the flue gases with fly ash, and sulphur oxides are not allowed to be discharged from the soda recovery boiler in gaseous form or to render the fly ash acidic. The drawback of acidic fly ash is that it causes the heat surfaces of the boiler to become clogged. Correspondingly, if there is too little sodium in the soda recovery boiler, the amount of sulphur emissions increases. It is possible to adjust the S/Na ratio in the flue gases of a soda recovery boiler to some extent by adjusting the temperature of the boiler bed, as the form in which the sodium compounds are present in the gases within the soda recovery boiler depends on the temperature of the bed. However, this is not always sufficient, and particularly when odour gases are supplied to the soda recovery boiler for burning, it is necessary to introduce sodium separately into the boiler as a compound by means of which it is possible to bring about the necessary reactions for binding sulphur to form sodium sulphate. For this purpose, there is supplied to the soda recovery boiler 7 sodium hydroxide, sodium carbonate compounds, another suitable Na compound or soap from the soap separation step 4. Thus the advantageous S/Na ratio in the flue gases of the soda recovery boiler is maintained. In addition, when the S/Na ratio of the black liquor is about 0.45 and the surface temperature of the boiler bed is from 900° to 1250° C., preferably from 1100° to 1200° C., the gaseous sodium chloride separated from the boiler bed together with sulphur dioxide and water forms sodium sulphate and hydrogen chloride as follows:

$$2NaCl+SO_2+H_2O+\tfrac{1}{2}O_2 \rightarrow Na_2SO_4+2HCl$$

Correspondingly, the Na carbonate in the soda recovery boiler reacts with sulphur dioxide, forming sodium sulphate and carbon dioxide:

$$Na_2CO_3+SO_2+\tfrac{1}{2}O_2 \rightarrow Na_2SO_4+CO_2$$

Thus the sulphur is converted into solid form while any possible chlorine is washed off as hydrogen chloride in a flue gas scrubber 9. The flue gas scrubber is generally known per se, and likewise the scrubbing off of detrimental substances from flue gas in connection with both the cooking of pulp and the soda recovery boiler process and even in other connections is generally known; therefore they will not be dealt with more closely herein. The most simple way to add sodium is to use separate sodium hydroxide or sodium carbonate compounds, which are easy to obtain and which are thus easy to use in connection with a sulphate pulp process. In cases where, for example, all of the soap is for some reason not used for the cooking of tall oil, the excess soap can be supplied to the soda recovery boiler 7 on account of the sodium it contains, in which case it at least partly replaces the sodium hydroxide, sodium carbonate compounds or the like. When soap is supplied to a soda recovery boiler, the thermal energy contained in the soap is recovered at the same time as the desired S/Na ratio in the flue gases is obtained. The green liquor formed from the smelt from the soda recovery boiler 7 and water is conducted to a causticizing step 10 and thereafter further as cooking liquor to the cooking step 2. It is possible to recycle all of the washing solution, or wash liquor, discharged from the flue gas scrubber to the process, or part of it can be separated and removed from the process, whereby part of the chlorine which usually tends to accumulate in the process is also removed.

The invention is described above and shown in the drawing merely by way of example, and it is in no way limited to the example. The supply of sodium hydroxide, some other Na compound or soap can be varied in various ways for different reasons, whereby all strong sulphurous odour gases can be introduced into the soda recovery boiler, and soap or sodium hydroxide is added in such an amount that substantially all chlorine is discharged as hydrogen chloride, which can be washed off in the flue gas scrubber, and correspondingly, substantially all sulphur is made to react so as to form sodium sulphate. If necessary, part of the odour gases can be conducted either to a separate step for treating odour gases or to a lime sludge reburning kiln to be treated in a manner known per se.

We claim:

1. A method for adjusting the sulfur to sodium ratio in the flue gases of a soda recovery boiler when sulphurous odor gases generated in a pulping process are burned in the boiler, comprising the steps of:

(a) feeding black liquor generated from the pulping process to the soda recovery boiler for combustion and generation of flue gases;

(b) introducing the sulphurous odor gases generated in the pulping process into said recovery boiler and combusting the gases therein to generate flue gases;

(c) introducing sodium compounds, separately from the black liquor, into the said recovery boiler;

(d) controlling the sulfur to sodium ratio in the flue gases by adjusting the feed rate of sodium compounds so that the sulphur dioxide generated in said recovery boiler combines with the sodium compounds to form sodium sulphate in solid form; and (e) separating the sodium sulphate solids from the flue gases in said recovery boiler.

2. A method according to claim 1 wherein part of the introduced sodium compounds is sodium hydroxide.

3. A method according to claim 1 wherein part of the introduced sodium compounds is sodium carbonate compounds.

4. A method according to claim 1 wherein at least part of the introduced sodium compounds is soap separated from the black liquor.

5. A method according to claim 1 wherein the surface temperature of the bed of the soda recovery boiler is from 900° to 1250°.

* * * * *